US005532101A

United States Patent [19]

Nozawa et al.

[11] Patent Number: 5,532,101

[45] Date of Patent: Jul. 2, 1996

[54] IMAGE FORMING METHOD

[75] Inventors: Keita Nozawa; Satoshi Yoshida; Tsutomu Kukimoto, all of Yokohama, Japan

[73] Assignee: Canon Kabushiki Kaisha, Tokyo, Japan

[21] Appl. No.: 526,564

[22] Filed: Sep. 11, 1995

Related U.S. Application Data

[63] Continuation of Ser. No. 74,567, Jun. 10, 1993, abandoned.

[30] Foreign Application Priority Data

Jun. 15, 1992 [JP] Japan ..... 4-178904

[51] Int. Cl.[6] ..... G03G 13/16; G03G 21/10

[52] U.S. Cl. ..... 430/125; 430/126; 355/277

[58] Field of Search ..... 430/125, 126, 430/111; 355/277

[56] References Cited

U.S. PATENT DOCUMENTS 4,998,143 3/1991 Kumasaka et al. ..... 355/271

5,009,973 4/1991 Yoshida et al. ..... 430/111

*Primary Examiner*—Christopher D. Rodee

*Attorney, Agent, or Firm*—Fitzpatrick, Cella, Harper & Scinto

[57] ABSTRACT

An image forming method, including steps of: charging a photosensitive member; exposing the photosensitive member so that an electrostatically charged image is formed; developing the electrostatically charged image so that a toner image is formed; transferring the toner image to a transfer member by transfer means; and cleaning residual toner particles on the photosensitive member by cleaning means after the toner image has been transferred, wherein the photosensitive member rotates at peripheral speed V (mm/sec); the transfer means is disposed so that the distance from a developing position on the photosensitive member to a transfer position in a direction of rotation of the photosensitive member is $d_1$ (mm); $d_1/v$ is 0.17 sec. or less; and developing the electrostatically charged image with toner having a triboelectric charge of |5| to |50| μc/g and containing 30% by number or less of toner particles having sizes below 4 μm.

21 Claims, 4 Drawing Sheets

IMAGE FORMING METHOD

This application is a continuation of application Ser. No. 08/074,567 filed Jun. 10, 1993, now abandoned.

BACKGROUND OF THE INVENTION

1. Field of the Invention and Related Art

The present invention relates to an image forming method having a developing process, a transfer process and a cleaning process.

Because of the recent tendency in size reduction and in the rise of the operational speed in electrophotographic apparatus there is a desire to shorten the circumference of the photosensitive member and to raise the rotational speed at the outer periphery of the photosensitive member.

However, use of a photosensitive member of the type having a short circumference at a high speed causes the time taken for developed toner to be brought to the transfer step and the cleaning step to be much reduced. Therefore, little or no reduction of the charge on the surface of the photosensitive member and on the developed toner takes place until the toner is introduced into the transfer step and the cleaning step. Hence, the adhesion of the toner to the surface of the photosensitive member is too strong, causing problems to arise in that the transfer ratio is unsatisfactory, the desired density cannot be realized in the formed image, and the excess toner to be processed increases excessively.

What is worse, the residual toner that has not been transferred cannot easily be removed, causing a problem that the toner undesirably passes through a cleaner or another problem that the toner adheres to the surface of the photosensitive member.

SUMMARY OF THE INVENTION

The present inventors have conducted studies to overcome the foregoing problems, and have determined that toner particles contained in the toner and having a relatively small particle size exhibit a strong adhesion force to the surface of the photosensitive member, and, accordingly, they cannot easily be transferred and cleaned.

An object of the present invention is to provide an image forming method capable of forming a high quality image, even if the method is employed in a compact and high speed image forming apparatus, and reducing the quantity of excess toner to be eliminated.

Another object of the present invention is to provide an image forming method enabling cleaning to be easily performed and preventing adhesion of toner to the photosensitive member even if the method is adapted to a compact and high speed image forming apparatus.

According to one aspect of the present invention, there is provided an image forming method comprising:

charging a photosensitive member rotating at a peripheral speed V (mm/sec.);

exposing the photosensitive member so that an electrostatically charged image is formed;

developing the electrostatically charged image at a developing position with a toner having a triboelectric charge of |5| to |50| μc/g and containing 30% by number or less of toner particles having sizes below 4 μm so that a toner image is formed;

transferring the toner image at a transfer position to a transfer member by a transfer means, said transfer means disposed so that the distance from the developing position on the photosensitive member to the transfer position in a direction of rotation of the photosensitive member is $d_1$ (mm) wherein the ratio $d_1/v$ is 0.17 sec. or less; and cleaning residual toner particles on the photosensitive member by cleaning means after the toner image has been transferred.

Other and further objects, features and advantages of the invention will be appear more fully from the following description.

DETAILED DESCRIPTION OF THE INVENTION

Figure 1:
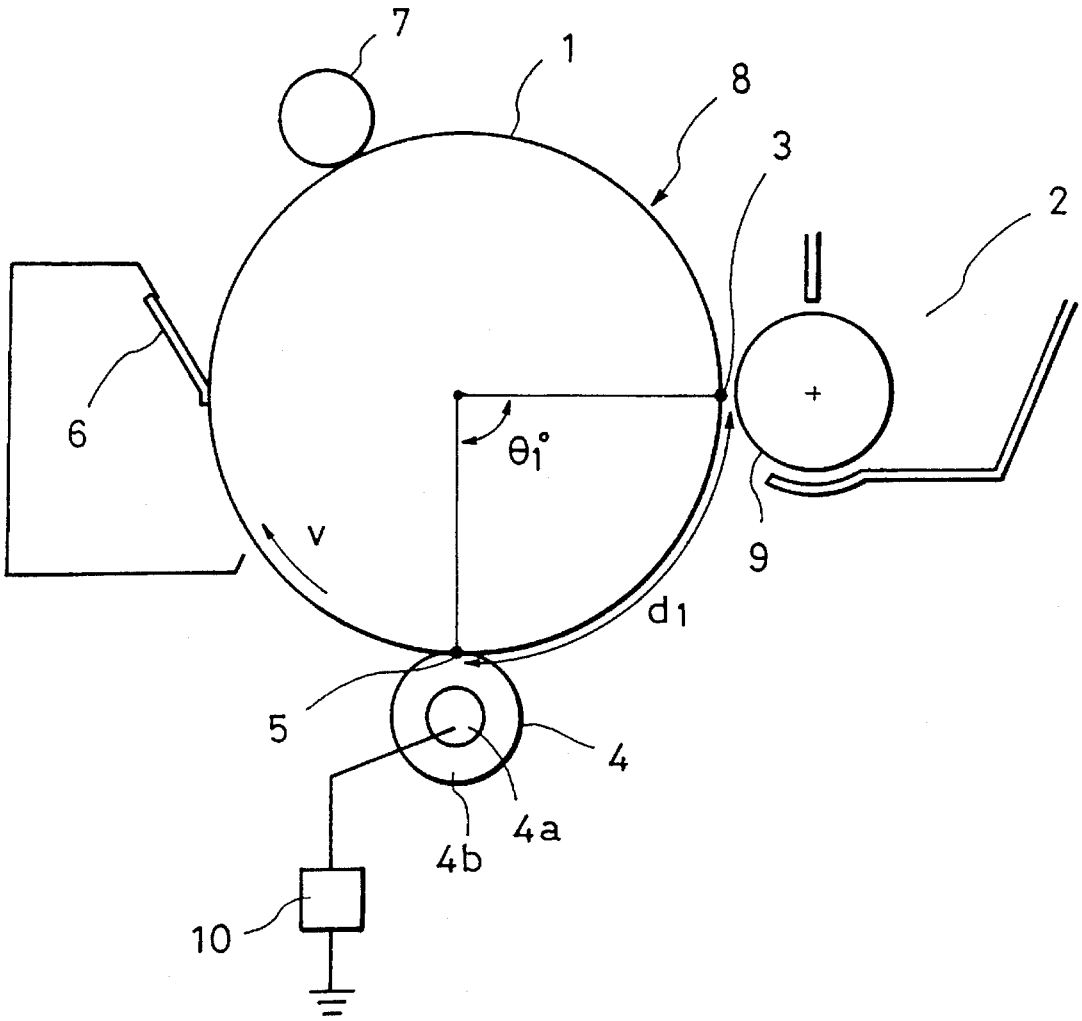
FIG. 1 is a schematic view which illustrates an example of an image forming apparatus for use in the present invention.

In an image forming apparatus, little or no reduction or neutralization of the charge present on the surface of the photosensitive member and that of the charge of the developed toner takes place in the following cases: the distance $d_1$ (mm) between the developing position and the transfer position on the surface of the photosensitive member of the image forming apparatus is too short; the peripheral speed v (mm/sec) of the photosensitive member is too high and the time $d_1/v$ (sec) taken for the developed toner to reach the transfer position is too short as expressed below:

$$d_1/v \leqq 0.17 \text{ sec}$$

As a result, toner transfer cannot easily be performed because the transfer step starts while a strong adhesion force is maintained between the toner and the surface of the photosensitive member.

In a preferred embodiment if the distance $d_2$ (mm) between the developing position and the cleaning position on the surface of the photosensitive member of the image forming apparatus is too short, the peripheral speed v (mm/sec) of the photosensitive member is too high and the time $d_1/v$ (sec) taken for the developed toner to reach the transfer position is too short as expressed below:

$$d_2/v \leqq 0.32 \text{ sec}$$

As a result, the cleaning process starts while a strong adhesion force exists between the residual toner and the surface of the photosensitive member. Hence, there arises problems in that since cleaning cannot easily be performed, defective cleaning results or undesirable adhesion of the toner to the surface of the photosensitive occurs.

However, toner for use in the present invention contains 30% by number or less (preferably 25% by number or less, more preferably 20% by number or less) of toner particles having sizes below 4 μm (that have strong adhesion force to the surface of the photosensitive member), resulting in a high transfer ratio to be obtained even if the toner is used in an image forming apparatus of the foregoing type. As a result, an excellent image exhibiting a high image density can be obtained. Further, cleaning can easily be performed, and the adhesion of the toner to the surface of the photosensitive member can satisfactorily be prevented.

If the quantity of toner particles having sizes below 4 μm is larger than 30% by number, the transfer ratio can easily be lowered, resulting in an increase in the quantity of the residual toner.

The toner for use in the present invention has a triboelectric charge of 5 to 50 μc/g (preferably 5.5 to 45 μc/g, more preferably 6 to 42 μc/g).

If the triboelectric charge is 50 μc/g or less, the quantity of toner containing toner particles having sizes below 4 μm (the quantity of the toner containing in the original toner and having the particles sizes below 4 μm may be the same), that cannot easily be transferred and cleaned, decreases in the toner to be developed on the photosensitive member due to a reason that has not been clarified yet. As a result, the transfer and cleaning can easily be performed even in the image forming apparatus of the foregoing type. Therefore, the undesirable result of cleaning and the adhesion of toner to the surface of the photosensitive member cannot easily take place.

If the triboelectric charge of toner is larger than 50 μc/g, the foregoing effect cannot therefore be obtained. If the triboelectric charge of the toner is smaller than 5 μc/g, a problem takes place, for example, in that toner flies undesirably. The toner for use in the present invention causes a significant beneficial effect to be obtained, particularly when it is used in an image forming apparatus adapted to a one-component development method that does not use a carrier.

The distribution of toner particles of the toner was measured herein by using a coulter counter.

As a measuring apparatus, a coulter counter TA-II (manufactured by Coulter) is used to which an interface (manufactured by Nikkaki) and a personal computer CX-1 (manufacture by Canon) are connected. Extra-grade sodium chloride is used to prepare 1% NaCl water solution serving as an electrolytic solution. The measurement is performed by adding an interfacial active agent (preferably alkyl benzene sulfonate in amounts of by 0.1 to 5 ml, followed by adding a measuring sample of 2 to 20 mg. The electrolytic solution, in which the sample is suspended, is subjected to a dispersion process in an ultrasonic disperser for about 1 to 3 minutes. Then, the coulter counter TA-II is used while employing an aperture having a size of 100μ so that the distribution of the number of particles having sizes from 2 to 40μ was measured. Thus, the value according to the present invention is obtained.

The method of measuring the triboelectric charge of the toner according to the present invention will now be described with reference to the drawings.

Figure 3:
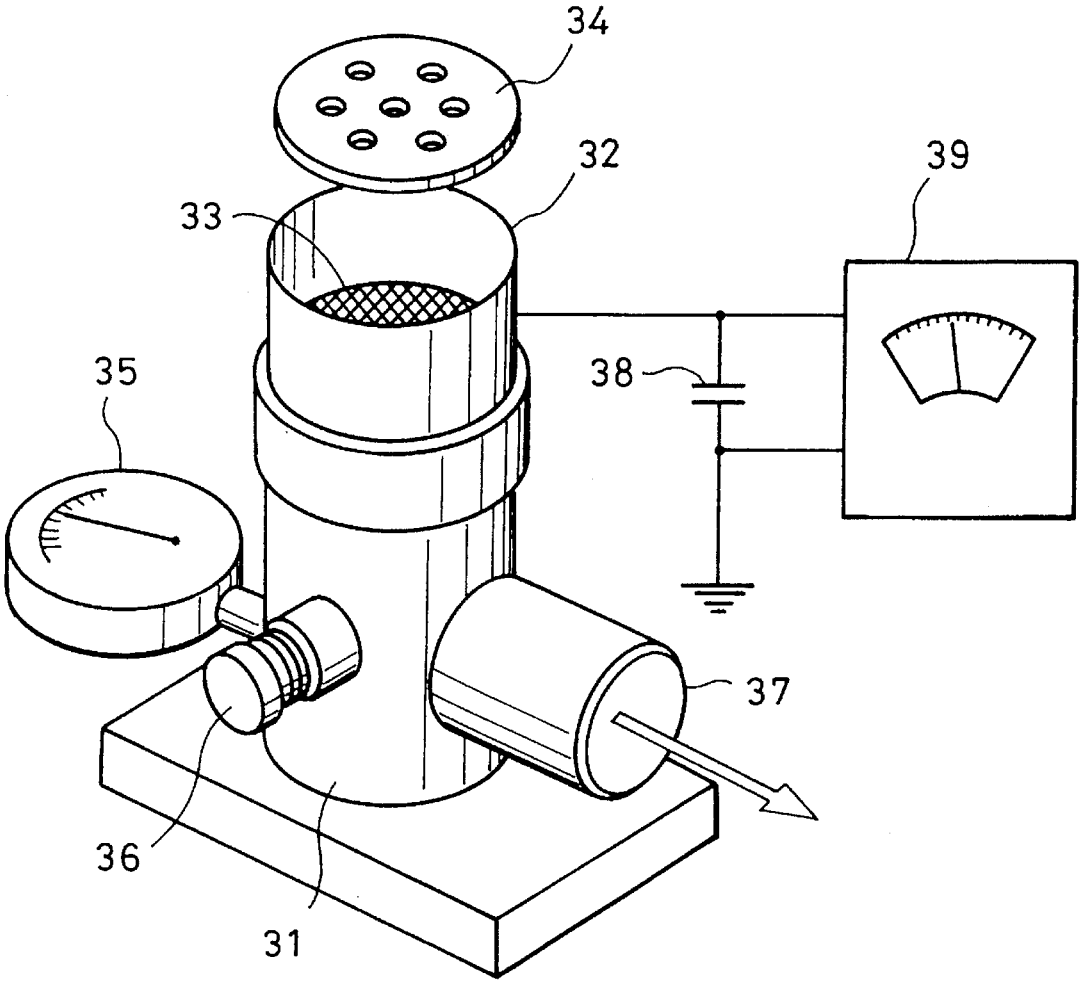
FIG. 3 illustrates an apparatus for measuring the triboelectric charge of toner.

FIG. 3 illustrates the apparatus for measuring the triboelectric charge of toner. First, about 1 g of mixture containing toner, the triboelectric charge of which is to be measured, and iron powder carrier (200 to 300 mesh) mixed at a weight ratio of 1:9 was injected into a measuring chamber 32 having a 400-mesh screen 33 on the bottom thereof and made of metal, followed by placing a metal cover 34 on the measuring chamber 32. An assumption is made here that the overall weight of the measuring chamber 32 at this time is weight $W_1$ (g). Then, a suction machine 31 (made of an insulating material in at least a portion which is in contact with the measuring chamber 32) is used to create a vacuum about from the mixture, while adjusting an air-quantity adjusting valve 36 to set the pressure of a vacuum meter to 25 $mmH_2O$. In this state, the toner is sufficiently exposed to a vacuum (for one minute) so that the toner is removed due to the suction operation. Another assumption is made here that the potential of a potentiometer 39 at this time is V (volts). The capacity of a capacitor 38 is assumed to be C (μF). An assumption is made that the overall weight of the measuring chamber 32 measured after the toner has been exposed to vacuum is weight $W_2$ (g). The triboelectric charge of the toner is calculated by the following equation:

$$\textit{Triboelectric charge}\ (\mu c/g)=(C\times V)/(W_1-W_2)$$

It should be noted that the measurement is performed at 23° C. and 60 % RH. The 200 to 300 mesh carriers (iron powder) are used in the measurement in such a manner that the carriers are sufficiently treated by the foregoing suction machine 31 to remove the carriers that pass through the 400-mesh screen 33 in order to prevent occurrence of an error in the measurement.

The preferred time in which the mixture is treated is about 20 seconds.

It is preferable that the toner for use in the present invention contains inorganic fine powder to which silicone oil or silicone varnish is adsorbed. The inorganic fine powder containing the adsorbed silicone oil or the silicone varnish and exhibiting small surface energy effectively improves the ease of separation between the toner particles developed on the surface of the photosensitive member and the surface of the photosensitive member. Furthermore, the treated fine powder is able to effectively prevent adhesion of the toner particles.

Silicone oil for use in the present invention is, for example, a type expressed as follows:

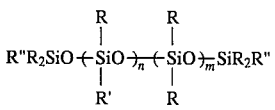

where R is an alkyl group having 1 to 3 carbon atoms ($C_1$ to $C_3$), R' is a silicone oil denatured group such as an alkyl group, a halogen denatured alkyl group, a phenyl group or a phenyl group having a substitutional group, and R" is an alkyl group having $C_1$ to $C_3$ or an alkoxy group.

For example, the silicone oil is exemplified by dimethyl silicone oil, alkyl denatured silicone oil, α-methyl styrene denatured silicone oil, chlorophenyl silicone oil, and fluorine denatured silicone oil. It is preferable that the silicone oil has a viscosity of about 50 to 1000 centistokes at 25° C. Silicone oil having a low viscosity and having too small a molecular weight sometimes generates volatile substances due to heat treatment. If the viscosity is high and the molecular weight is too heavy, such silicone oil cannot easily be processed.

Furthermore, silicone oil having a composition unit expressed as follows may be employed in the present invention:

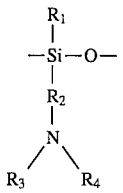

where $R_1$ is hydrogen, an alkyl group, aryl group or an alkoxy group, $R_2$ is an alkylene group or a phenylene group, and $R_3$ and $R_4$ are hydrogen, alkyl groups or aryl groups. The alkyl group, aryl group, alkylene group and the phenylene group are capable of containing amine or a substituted group, such as halogen, in a range in which the ease of charging does not deteriorate.

Among the foregoing silicone oils, it is preferable to employ silicone oil of a type exhibiting an amine equivalent (equivalent (g/equiv.) per one amine.) of 2000 or less, more preferably 1000 or less, the value being obtained by dividing the molecular weight of silicone oil by the number of amines per molecule.

It is preferable to employ silicon of a type containing a quaternary ammonium salt formed by making the amino group to be quaternized.

The method of processing silicone oil may be a known method. For example, the following methods may be employed: a method in which inorganic fine powder and silicone oil are mixed by using a mixer, a method in which silicone oil is sprayed into inorganic fine powder, and a method in which silicone oil is dissolved in a solvent, followed by mixing inorganic fine powder. The present invention is not limited to the foregoing methods.

The inorganic fine powder for use in the present invention may be an oxide or a double oxide of Mg, Al, Si, Ca, Ti, V, Cr, Mn, Fe, Co, Ni, Cu, Zn, Ge, Sr, Sn, Ba, or Ce. In particular, it is preferable to employ the oxide of Al, Si or Ti.

As for the particle size of the inorganic fine powder, it is preferable that the average primary particle size is 0.001 to 2 μm (preferably 0.002 to 2 μm).

It is preferable that the quantity of the adsorbed silicone oil is 5 to 50 parts by weight with respect to 100 parts by weight of inorganic fine powder.

It is preferable that the content of the inorganic fine powder to which silicone oil is adsorbed in the toner is 0.01 to 15 (preferably 0.02 to 10) parts by weight with respect to 100 parts by weight of the toner. It is preferable that the toner particles and the inorganic fine powder containing adsorbed silicone oil are mixed to make the inorganic fine powder containing adsorbed silicone oil mainly present on the surface of the toner.

The silicone varnish for processing the inorganic fine powder for use in the present invention may be known material.

It is exemplified by KR-251 and KP-112 and the like manufactured by Sinetsu Silicon for example. However, the present invention is not limited to this.

The silicone varnish may be processed by the known manner that is employed to process the silicone oil. The processed inorganic fine powder exhibits the desired effect when it is contained in amounts from 0.1 to 1.6 parts by weight with respect to 100 parts by weight of the toner, more preferably 0.3 to 1.6 parts by weight resulting in an excellent stability. If the content is less than 0.1 part by weight, the effect of the addition usually is unsatisfactory. If the content is larger than 1.6 parts by weight, problems of development and fixing can take place.

It is preferable that the wettability of the inorganic fine powder charged positively with respect to iron powder containing adsorbed silicone oil or silicone varnish having the side chain containing nitrogen atoms is 70 or more (preferable 75 to 98).

If the wettability is less than 70, the hydrophilic property of the inorganic fine powder causes the charge to be unstable under a high humidity environment, resulting in undesirable density of the formed image and fog to occur easily.

It is preferable that the wettability of inorganic fine powder charged negatively with respect to iron powder with adsorbed silicone oil or silicone varnish having the side chain containing no nitrogen atoms is 75 to 99.5 due to a similar reason.

The "wettability" of the inorganic fine powder with adsorbed silicone oil or silicone varnish is obtained from the following experiment.

Sample inorganic fine powder is gathered in a 200 ml separating funnel, followed by adding 100 ml of ion exchange water by a measuring cylinder. Then, the separating funnel is connected to a tumbler shaker mixer TC2 to disperse the sample for 10 minutes at 90 r.p.m. The separating funnel is then removed from the tumbler shaker mixer T2C, followed by placing it stationarily. Then, the sample is ejected in a quantity of 20 to 30 ml from the separating funnel, followed by separating it into 10 mm cells. The turbidity of the water layer indicated when the wavelength is 500 nm is measured while using ion exchange water as a blank (100%). The value (transmissivity T%) read at this time is the wettability.

In this experiment, the case where the inorganic fine powder is completely wetted with water is made to be zero wettability.

It is preferable that the toner for use in this embodiment contains magnetic particles including 50% by number or more (more preferably 70% by number or more, most preferably 80% by number or more) of magnetic particles each of which has a surface formed by a curved surface. Even if ordinary cubic system magnetic substance, the surface of which is formed by a plane, and which has square ends, is contained in the spherical magnetic substance, the content must be 50% by number or less, preferably 20% by number or less.

The spherical magnetic substance for use in the present invention contains an average particle size from 0.1 to 0.35 μm. The average particle size of the spherical magnetic substance according to the present invention is obtained by taking a photograph of the sample by using a scanning-type electron microscope to measure the major axis of the longer diameter of 100 to 200 particles selected randomly, followed by calculating their average. It is known that the toner containing the spherical magnetic substance exhibits an excellent state of distribution of the magnetic substance in comparison to the toner that contains a cubic-system magnetic substance. Therefore, the foregoing toner exhibits excellent development facility, and, accordingly, the ratio of the toner having the particle size of 4 μm or less is reduced in the size distribution of the toner particles developed on the photosensitive member, causing transfer and cleaning to be performed easily.

It is preferable that the magnetic substance contained in the toner for use in the present invention contain Si atoms an/or Al atoms.

Specifically, it is preferable that magnetic powder constituting the toner for use in the present invention contains elemental silicon and/or elemental aluminum in amounts from 0.05 to 10 wt % (more preferably 0.1 to 5 wt %).

If the content is less than 0.05 wt % the effect of the silicon and aluminum cannot be attained, resulting in unsatisfactory improvements in the transferring facility and cleaning facility in an environment of low temperature and low humidity.

In particular, it is preferable to use magnetic iron oxide containing silicon by using a silicone compound in the form of silicic acid or silicate in the manufacturing process. It is most preferable to use magnetic iron oxide in which the silicon element is present on the surface of magnetic powder.

In the case where aluminum element is employed, it is preferable to use magnetic iron oxide containing the aluminum element by using an aluminum compound in the form of aluminum hydroxide or aluminum oxide in the manufacturing process. It is most preferable to use the aluminum element when the silicon element is present on the surface of magnetic powder.

The content of silicon or aluminum in the magnetic powder is measured by the following method:

About 5 g of magnetic powder is injected into a 1-liter beaker (it is assumed to be A g/l), followed by adding 3N hydrochloric acid solution to make the overall quantity to be 1 liter. The temperature is maintained at about 50° C. and the reaction is continued while stirring the solution until the substance is completely dissolved and the solution becomes transparent. The quantity of dissolved elemental silicon or elemental aluminum (it is assumed to to be B mg/l) is measured from the obtained solution by a plasma light emission spectrum (ICP). The ratio of the silicon or aluminum with respect to the weight of the magnetic powder is calculated by the following equation:

$$\textit{Ratio (\%) of silicon element or aluminum element} = \{B/(A\times 1,000)\}\times 100$$

When the magnetic powder contained in the toner is analyzed, an organic solvent, such as xylene, which dissolves the resin component of the magnetic toner, is mixed with the toner. A solution, in which the resin component in the magnetic toner is dissolved, is filtered by a 20A paper filter so that residual magnetic powder on the 20A filter is gathered from the solution in which the resin component in the magnetic toner is dissolved. The gathered magnetic powder is processed in an atmosphere of 60° C. to removed organic components. Then, the obtained magnetic powder is analyzed by the foregoing method so that the ratio of the silicon element or the aluminum element to the magnetic powder is measured.

It is preferable to use as the magnetic powder in the present invention an alloy containing a ferromagnetic element or a powder of a compound containing the silicon element and/or aluminum element. For example, magnetite, magnetite, or ferrite that is alloy or a compound of iron, cobalt, nickel or manganese; or known magnetic material such as the other ferromagnetic alloy of a type which contains the silicon element and/or aluminum element in the manufacturing process is preferred.

The toner containing a magnetic substance of the foregoing type exhibits stable charging characteristics, resulting in reduction in the ratio of the toner particles having sizes below 4 μm in the distribution of the developed toner on the photosensitive member. Therefore, transfer and cleaning can easily be performed.

The binding resin to be employed in the toner for use in the present invention may be a single resin or a combination of resins selected from the variety of resins known as binding resins, the group consisting of styrene type resin, polyester type resin, acrylic type resin, phenol resin and epoxy resin.

As a coloring agent, known inorganic pigments, or organic dyes or pigments may be used. For example, any one of the following materials may be employed: carbon black, aniline black, acetylene black, naphthol yellow, Hansa Yellow, Rhodamine Lake, alizarin lake, iron oxide red, phthalocyanine blue, and Indanthrene blue. The selected coloring agent is usually used in amounts of 0.5 to 20 parts by weight with respect to 100 parts by weight of the binding resin.

Where the toner is used positively charged, it preferably contains a positive charge controlling agent, such as a triphenylmethane compound, nigrosine dye or a quaternary ammonium salt. Where the toner is used negatively charged, it preferably contains a negative charge controlling agent, such as a salicylic acid type metal complex or metal salt or acetyl acetone metal complex.

Other additives may be preferably added in so far as no substantial adverse affect takes place. The additives are exemplified by: lubricants such as Teflon particles, polyvinylidene fluoride particles, organic resin particles, or fatty acid metal salt; fixing assistants such as low molecular weight polyethylene; or a conductivity reinforcing agent such as tin oxide or zinc oxide.

An example of the image forming method according to the present invention will now be described by making use of the image forming apparatus shown in FIGS. 1 and 2.

Figure 2:
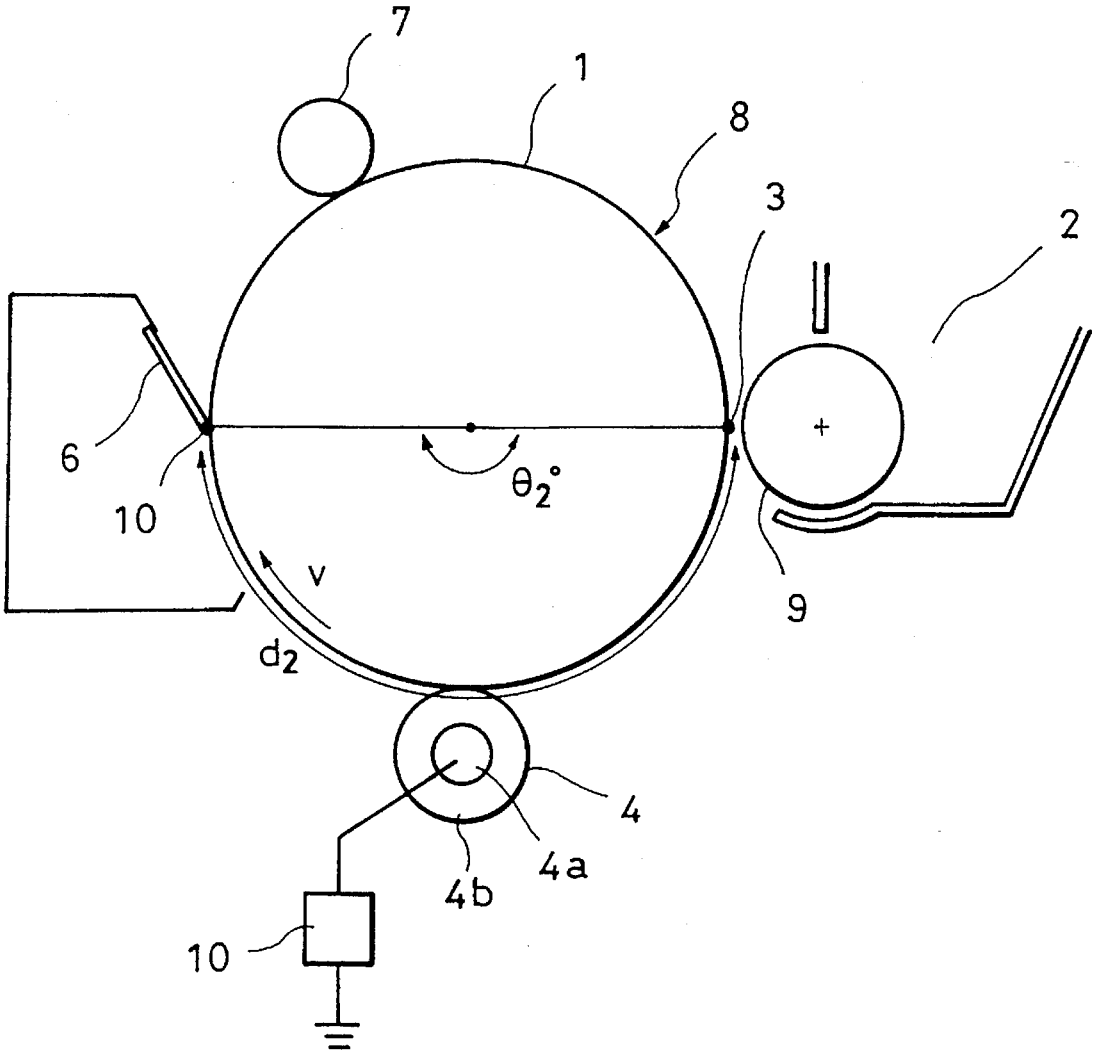
FIG. 2 is a schematic view which illustrates an example of an image forming apparatus for use in the present invention.

Referring to FIG. 1 and 2, the surface of a photosensitive member 1 is charged by a primary charger 7. The photosensitive member is a photosensitive drum having a diameter of 35 mm or less, preferably 30 mm or less, and most preferably 20 to 30 mm.

A latent image is formed by exposure light 8 (not shown), the latent image being then developed by a developing device 2. The nearest point on the photosensitive member 1 between the photosensitive member 1 and a developing sleeve 9 at this time is developing position 3.

The developed toner is transferred to a transfer agent by a transfer charger 4. The nearest point on the photosensitive member 1 between the photosensitive member 1 and the transfer charger 4 is transfer position 5 as shown in FIG. 1. Referring to FIG. 1, symbol $d_1$ represents the distance from the developing position 3 and the transfer position 5, while v represents the peripheral speed of the photosensitive member 1.

The transfer means of an electrophotographic apparatus for use in the image forming apparatus according to the present invention may be a contact type apparatus having a roller or a belt that is brought into contact with a latent-image carrier or a non-contact type apparatus that uses a corona charger. If the contact type transfer means is adapted to the image forming method according to the present invention, a significant effect can be obtained.

Figure 4:
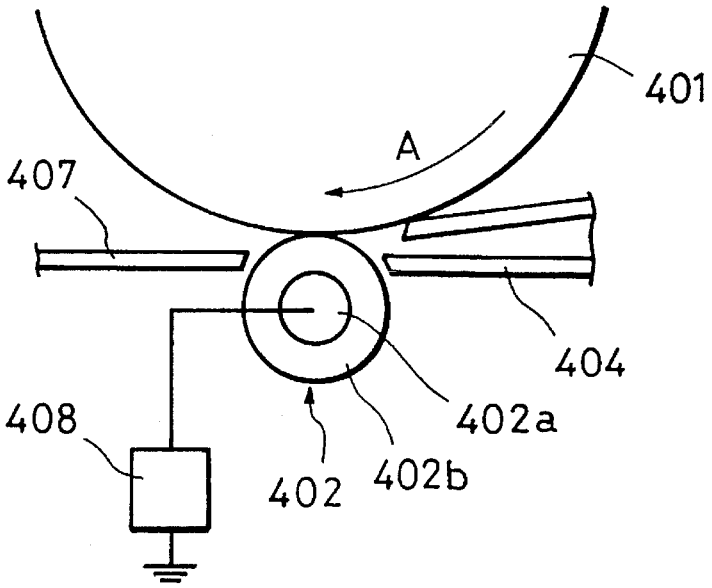
FIG. 4 is a schematic view which illustrates a transfer means using a transfer roller.
Figure 5:
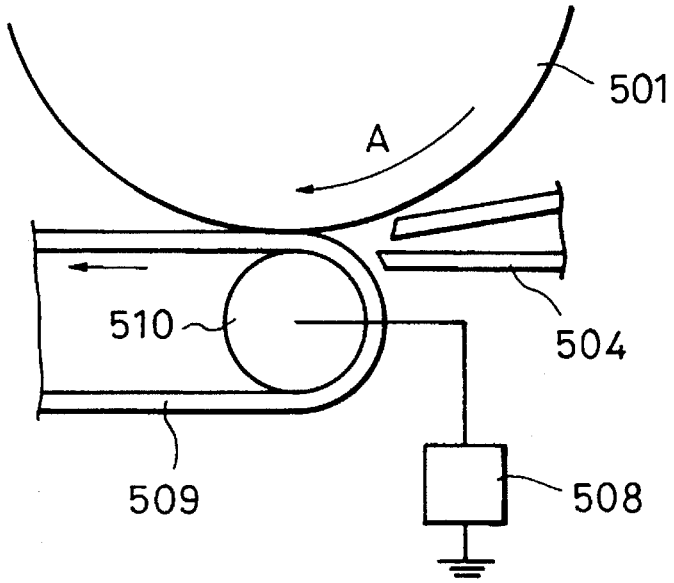
FIG. 5 is a schematic view which illustrates a transfer means using a transfer belt.

FIG. 4 is a schematic view which illustrates a transfer roller, and FIG. 5 is a schematic view which illustrates a transfer belt.

FIG. 4 is a schematic side elevational view which illustrates a typical example of an essential portion of the image forming apparatus of the foregoing type. The apparatus shown in FIG. 4 incorporates a latent-image carrier 401 extending perpendicular to the drawing sheet and rotating in a direction designated by an arrow A, and a conductive transfer roller 402 that comes in contact with the latent-image carrier 401.

The transfer roller 402 comprises a core **402*a* and a conductive elastic layer 402*b*, the conductive elastic layer 402*b*** being made of elastic material having a volume resistivity of about $10^6$ to $10^{10}$ Ωcm, such as a ternary copolymer ethylene-propylene-diene (EPDM) in which conductive material, such as carbon, is dispersed.

FIG. 5 illustrates a structure constituted by applying the present invention to a transfer belt. A transfer belt 509 is supported and rotated by a conductive roller 510. The transfer unit usually is applied with pressure by applying pressure to the core 502*a* or an end bearing of the core of the conductive roller 510.

It is preferable to set the pressure applied for the purpose of pressing the charger against the photosensitive member to 3 to 500 g/cm (more preferably 5 to 400 g/cm, most preferably 5 to 100 g/cm) as linear pressure.

The line pressure is calculated by the following equation:

$$\text{(Line Pressure)[g/cm]} = \frac{\text{total pressure applied to the transfer member [g]}}{\text{length of contact cm [cm]}}$$

If the contact pressure is less than 3 g/cm, the transfer member undesirably deflects in the conveyance operation and defective result of the transfer takes place due to lack of the transfer electric current.

In order to reduce the overall size of the apparatus, it is preferable to form the photosensitive member into a cylindrical shape.

If the latent-image carrier is formed into a cylindrical shape, it is preferable that the developing unit and a cleaner unit are disposed adjacent to an exposing optical system in order to prevent contamination of the exposing optical system occurring due to flying toner. In order to prevent the contamination of the optical system, it is therefore preferable that the transfer position is in an angle range from +10° to −30° made from the horizontal line at the center of the cylindrical photosensitive member.

It is preferable that the transfer position is arranged in such a manner that the toner is vertically downwards transferred to the transfer member in order to shorten the conveyance passage for the transfer member so as to reduce the overall size of the apparatus. Specifically, it is preferable that the transfer position is included in a range of ±20° from the vertical line of the center of the cylindrical photosensitive member. It is therefore preferable that the angle made by the developing position and the transfer position from the center of the cylindrical photosensitive member is included in a range from 40° to 120° (more preferably from 50° to 111°). It is also preferable that the cleaning position is included in a range from +10° to −30° from the horizontal line of the center of the cylindrical photosensitive member due to the same reason. It is therefore preferable that the angle made by the developing position and the cleaning position from the center of the cylindrical photosensitive member is included in a range from 120° to 200° (more preferably from 130° to 195° ).

The present invention will now be specifically described by making use of preferred illustrative examples. It should be noted that the parts described in such preferred embodiments is in parts by weight.

EXAMPLES 1 TO 5 AND COMPARATIVE EXAMPLE 1

A cylindrical photosensitive member comprising an organic photosensitive member on the surface thereof and having an outer diameter of 30 mm was used. The developing device and the transfer device were set to make angle θ1 between the developing position and the center of the cylindrical photosensitive member and between the transfer position and the foregoing center was about 90°, the distance $d_1$ between the developing position and the transfer position on the photosensitive member was 23.6 mm. Further, the peripheral speed of the cylindrical photosensitive member was set to be 250 mm/sec ($d_1$/v=0.09 sec). In addition, each angle θ2 made between the developing position and the center of the cylindrical photosensitive member and between the cleaning position and the cylindrical photosensitive member was about 180° C. As the developing device, a developing device for one-component magnetic toner was used, while a transfer roller (a transfer roller for LBP-A404 applied with a negative bias in this example) was employed as the transfer device. As the primary charger, a charging roller was employed.

The distance from the cylindrical photosensitive member and the developing sleeve was set to about 300 μm. Further, a DC bias of about −200 V and an AC bias, the Vpp of which was about 1200 V and the frequency of which was about 1800 Hz, were applied to the developing sleeve. An electrostatic latent image was developed by using the magnetic toner of Table A.

The transfer roller and the transfer belt were rotated at the same peripheral speed as that of the latent image carrier or at a speed that is slightly different, followed by applying a bias of DC voltage of ±0.2 to ±10 KV at the time of the transfer operation.

Since the contact-type transfer device is able to sufficiently transfer the toner with a relative low voltage bias in comparison to the corona transfer device, it is superior in terms of reducing the overall size of the discharge and preventing generation of products, such as ozone, which are generated due to the corona discharge.

The toner transferred to the transfer member is fixed by a fixing unit so that a final image is obtained.

A portion of the toner that has not been transferred and left on the photosensitive member is removed from the surface of the photosensitive member by a cleaner 6 as shown in FIG. 2. The nearest point (which is the contact position with a blade when blade cleaning is employed) between the photosensitive member 1 and the cleaner 6 on the photosensitive member is cleaning position 10.

It is preferable that the cleaning means for the electrophotographing apparatus for use in the image forming method according to the present invention is a blade cleaning means or roller cleaning means. The blade cleaning means includes a blade made of urethane rubber, silicone rubber or resin having elasticity or a blade unit which comprises a tip-like resin held at the leading portion of a blade made of metal or the like. Further, the blade or the blade unit is brought into contact with the photosensitive member in the same direction or in the opposite direction with respect to the direction of rotation of the photosensitive member. It is preferable that the blade is brought into contact with the photosensitive member facing the same direction with respect to the direction of rotation of the photosensitive member. It is preferable that the pressure of the contact of the blade with the photosensitive member is 5 g/cm or more by line pressure, more preferably 10 to 50 g/cm. A combination may be employed of the blade cleaning method and any one of mag-brush cleaning method, fur-brush cleaning method and a roller-cleaning method and the like.

Referring to the FIG. 2, symbol $d_2$ represents the distance from the developing position 3 and the cleaning position 10 on the photosensitive member 1.

The foregoing apparatus is an example of an arrangement where the primary charger 7 comprises a roller charger and the transfer charger 4 comprises a roller transfer device.

It is preferable that the image forming apparatus according to the present invention constituted as shown in FIGS. 1 and 2 has an arrangement that $d_1/v$ is 0.17 sec or less, more preferably 0.15 or less, and most preferably 0.10 to 0.13. Furthermore, it is preferable that $d_2/v$ is 0.32 sec or less, more preferably 0.30 or less, and most preferably 0.20 to 0.25.

TABLE A

| | |
|---|---|
| styrene-n-butyl-acrylate copolymer (copolymerization ratio 80:20) | 100 parts |
| magnetite | 80 parts |
| nigrosine dye (charge controlling agent) | 2 parts |
| low molecular weight polypropylene | 4 parts |

The foregoing material was sufficiently mixed by a Henschel mixer, followed by kneading with an extruder set to 130° C. After the temperature was reduced, the kneaded material was coarsely milled by a cutter mill, followed by fine milling employing a jet mill making use of a jet stream and finally the material was classified by a pneumatic classifier. As a result, black fine powder (magnetic toner particles) was obtained.

Then, 0.6 part of colloidal silica was added to 100 parts of the black fine powder, followed by mixing with the Henschel mixer. As a result, magnetic toner was obtained.

By performing an adjustment in the fine milling process/classifying process, magnetic toner samples having particle size distributions shown in Table 1 were manufactured.

The magnetic toner was adapted to the foregoing image forming apparatus, following by measuring the transfer ratio at a temperature of 23° C. and a humidity of 60 % RH. The results are shown in Table 1.

A transfer roller (volume resistivity $10^8$ Ω.cm) for a laser beam printer LBP-A404 manufactured by Canon was employed. The transfer roller was brought into contact with the cylindrical photosensitive member at a contact pressure of about 10 g/cm. While rotating the cylindrical photosensitive member and the transfer roller at the same speed, a DC voltage of about −2 KV was applied at the time of the transfer operation.

TABLE 1

| | Average size of particles of toner (μm) | Proportion of toner having sizes below 4 μm (% by number) | Quantity of charged toner (μc/g) | Transfer ratio (%) |
|---|---|---|---|---|
| Example 1 | 7.1 | 4 | +19 | 93 |
| Example 2 | 7.1 | 8 | +19 | 93 |
| Example 3 | 7.0 | 12 | +20 | 91 |
| Example 4 | 6.9 | 18 | +20 | 89 |
| Example 5 | 6.7 | 24 | +22 | 86 |
| Comparative Example 1 | 6.6 | 35 | +23 | 76 |

EXAMPLES 6 AND 7

Toner was manufactured by a method similar to that according to Example 2 except for employing the quantity of the charge controlling agent as shown in Table 2 and for the change in the quantity of the charged toner. Experiments were conducted similarly to Example 1, resulting in values as shown in Table 2.

TABLE 2

| | Charge control agent Nigrosine dye (w %) | Average size of particles of toner (μm) | Proportion of toner having sizes below 4 μm (% by number) | quantity of charged toner (μc/g) | Transference ratio (%) |
|---|---|---|---|---|---|
| Example 6 | 0.5 | 7.1 | 8 | +11 | 91 |
| Example 7 | 1 | 7.1 | 8 | +17 | 92 |

As the cleaning means, a urethane rubber cleaning blade was used. The cleaning blade was brought into contact with the cylindrical photosensitive member in an opposite direction to the rotational direction of the cylindrical photosensitive member at a contact pressure of about 25 g/cm.

The transfer ratio was obtained as follows: a solid black image was developed and transferred to measure both (i) the quantity of the toner (per unit area) on the photosensitive member attained before transfer had been made and (ii) the quantity of toner (per unit area) on the transfer member. Transfer ratio was calculated using the following equation:

Transference Ratio (%)=(quantity of toner on the transfer member)/(quantity of toner on the transfer member prior to performing transfer)×100

EXAMPLE 8

An image forming apparatus arranged similarly to Example 1 was provided except for an arrangement that the conditions of the potential on the surface of the photosensitive member, the developing bias and the transfer bias of the image forming apparatus according to Example 1 were set to the reversal developing conditions and that laser beams were used to expose the toner.

The distance from the cylindrical photosensitive member and the developing sleeve was set to about 300 μm. Further, a DC bias of about −500 V and an AC bias, the Vpp of which was about 1400 V and the frequency of which was about 1800 Hz, were applied to the developing sleeve. An electrostatic latent image was developed by using the following magnetic toner.

| Magnetic Toner | |
|---|---|
| styrene-n-butyl-acrylate-maleic acid monobutyl ester copolymer (77:20:3) | 100 parts |
| magnetite | 100 parts |
| Azo pigment containing metal | 0.5 part |
| low molecular weight polypropylene | 4 parts |

The foregoing material was sufficiently mixed by a Henschel mixer, followed by kneading with an extruder set to 130° C. After the temperature was reduced, the kneaded material was coarsely milled by a cutter mill, followed by fine milling employing a jet mill making use of a jet stream and finally the material was classified by a pneumatic classifier. As a result, black fine powder (magnetic toner particles) was obtained.

Then, 1.6 parts of colloidal silica was added to 100 parts of the black fine powder, followed by mixing with a Henschel mixer. As a result, a magnetic toner was obtained.

A transfer roller (volume resistivity $10^8$ Ω.cm) for a laser beam printer LBP-A404 manufactured by Canon was employed. The transfer roller was brought into contact with the cylindrical photosensitive member at a contact pressure of about 15 g/cm. While rotating the cylindrical photosensitive member and the transfer roller at the same speed, a DC voltage of about +2 KV was applied at the time of the transfer operation.

As the cleaning means, a urethane rubber cleaning blade was used. The cleaning blade was brought into contact with the cylindrical photosensitive member in an opposite (contra-rotatory) direction to the rotational direction of the cylindrical photosensitive member at a contact pressure of about 30 g/cm.

The magnetic toner was adapted to the foregoing image forming apparatus, following by measuring the transfer ratio at a temperature of 23° C. and a humidity of 60 % RH. The results of the measurement are shown in Table 3.

TABLE 3

| | Average size of particles of toner (μm) | Proportion of toner having sizes below 4 μm (% by number) | Quantity of charged toner (μc/g) | Transfer ratio (%) |
|---|---|---|---|---|
| Example 8 | 5.8 | 18 | −33 | 90 |

EXAMPLES 9 TO 13 AND COMPARATIVE EXAMPLE 2

A cylindrical photosensitive member comprising an organic photosensitive member on the surface thereof and having an outer diameter of 25 mm was used. The developing device and the transfer device were set to make an angle between the developing position and the center of the cylindrical photosensitive member and between the transfer position and the foregoing center of about 90°. The distance $d_1$ between the developing position and the transfer position on the photosensitive member was about 19.7 mm. In addition, the cleaning device was set, so that each angle θ2 between the developing position and the center of the cylindrical photosensitive member and between the cleaning position and the cylindrical photosensitive member was about 180° C. (the distance $d_2$ between the developing position and the cleaning position on the photosensitive member was 39.3 mm). Further, the peripheral speed of the cylindrical photosensitive member was set at 180 mm/sec ($d_2/v$=0.22 sec). As the developing device, a developing device for a one-component magnetic toner prepared in the same manner as in Example 1 was used.

The distance from the cylindrical photosensitive member and the developing sleeve was set to about 300 μm. Further, a DC bias of about −200 V and an AC bias, the Vpp of which was about 1200 V and the frequency of which was about 1800 Hz, were applied to the developing sleeve. An electrostatic latent image was developed by using the following magnetic toner.

A transfer roller (volume resistivity $10^8$ Ω.cm) for a laser beam printer LBP-A404 manufactured by Canon was employed. The transfer roller was brought into contact with the cylindrical photosensitive member at a contact pressure of about 8 g/cm. While rotating the cylindrical photosensitive member and the transfer roller at the same speed, a DC voltage of about 1.5 KV was applied at the time of the transfer operation.

As the cleaning means, the urethane rubber cleaning blade was used. The cleaning blade was brought into contact with the cylindrical photosensitive member in a contrarotatory direction to the moving direction of the cylindrical photosensitive member at a contact pressure of about 25 g/cm.

As the primary charger, a charging roller was used.

Similarly to Example 1, magnetic toner samples having particle size distributions as shown in Table 4 were made.

The toner thus made was used to output 5,000 A4-longitudinal sheets at a temperature of 23° C. and 60 % RH to evaluate the cleaning facility and the adhesion of the toner to the photosensitive member. The results are as shown in Table 4.

TABLE 4

| | Average size of particles of toner (μm) | Proportion of toner having sizes below 4 μm (% by number) | Quantity of charged toner (μc/g) | Defective result in cleaning | Adhesion of toner |
|---|---|---|---|---|---|
| Example 9 | 7.1 | 4 | +19 | Not generated | Not generated |
| Example 10 | 7.1 | 8 | +19 | Not generated | Not generated |

TABLE 4-continued

| | Average size of particles of toner (μm) | Proportion of toner having sizes below 4 μm (% by number) | Quantity of charged toner (μc/g) | Defective result in cleaning | Adhesion of toner |
|---|---|---|---|---|---|
| Example 11 | 7.0 | 12 | +20 | Not generated | Not generated |
| Example 12 | 6.9 | 18 | +20 | Not generated | Not generated |
| Example 13 | 6.7 | 24 | +22 | Not generated | Not generated |
| Comparative Example 2 | 6.6 | 35 | +23 | Generated when 300 sheets were made | Generated when 1500 sheets were made |

EXAMPLES 14 AND 15

Toner was manufactured by a method similar to that according to Example 1 except for the quantity of the charge controlling agent in the toner arranged as shown in Table 5 and for the change in the quantity of the charged toner. Experiments were conducted similar to those of Example 9, resulting in values as shown in Table 5.

TABLE 5

| | Charge control agent nigrosine dye (w %) | Average size of particles of toner (μm) | Proportion of toner having sizes below 4 μm (% by weight) | Quantity of charged toner (μc/g) | Defects in cleaning | Adhesion of toner | Flying* of toner |
|---|---|---|---|---|---|---|---|
| Example 14 | 0.5 | 7.1 | 8 | +11 | Not generated | Not generated | Not observed |
| Example 15 | 1 | 7.1 | 8 | +17 | Not generated | Not generated | Not observed |

*"flying toner" was evaluated by observing the developing device and the lower stay of the developing sleeve.

EXAMPLE 16

An image forming apparatus arranged similarly to Example 9 was provided except that the conditions of the potential on the surface of the photosensitive member, the developing bias and the transfer bias of the image forming apparatus according to Example 9 were set to the reversal developing conditions and an arrangement that laser beams were used to expose the toner. Magnetic toner charged negatively was obtained similarly to Example 8.

The distance from the cylindrical photosensitive member and the developing sleeve was set to about 300 μm. Further, a DC bias of about −500 V and an AC bias, the Vpp of which was about 1400 V and the frequency of which was about 1800 Hz, were applied to the developing sleeve. An electrostatic latent image was developed by using the following magnetic toner prepared in the same manner as in Example 8.

A transfer roller (volume resistivity $10^8$ Ω.cm) for a laser beam printer LBP-A404 manufactured by Canon was employed. The transfer roller was brought into contact with the cylindrical photosensitive member at a contact pressure of about 12 g/cm. While rotating the cylindrical photosensitive member and the transfer roller at the same speed, a DC voltage of about +1.5 KV was applied at the time of the transfer operation.

As the cleaning means, a urethane rubber cleaning blade was used. The cleaning blade was brought into contact with the cylindrical photosensitive member in a contrarotatory direction to the moving direction of the cylindrical photosensitive member at a contact pressure of about 30 g/cm.

The magnetic toner was adapted to the foregoing image forming apparatus, following by measuring the transfer ratio at a temperature of 23° C. and a humidity of 60 % RH. The results of the measurement are shown in Table 6.

TABLE 6

| | Average size of particles of toner (μm) | Proportion of toner having sizes below 4 μm (% by number) | Quantity of charged toner (μc/g) | Defective result in cleaning | Adhesion of toner |
|---|---|---|---|---|---|
| Example 16 | 5.8 | 18 | −33 | Not generated | Not generated |

EXAMPLE 17

An image forming apparatus arranged similarly to Example 1 was used.

The distance from the cylindrical photosensitive member and the developing sleeve was set to about 300 μm. Further, a DC bias of about −200 V and an AC bias, the Vpp of which was about 1200 V and the frequency of which was about 1800 Hz, were applied to the developing sleeve. An electrostatic latent image was developed by using the following magnetic toner.

A transfer roller (volume resistivity $10^8$ Ω.cm) for a laser beam printer LBP-A404 manufactured by Canon was employed. The transfer roller was brought into contact with the cylindrical photosensitive member at a contact pressure of about 6 g/cm. While rotating the cylindrical photosensitive member and the transfer roller at the same speed, a DC voltage of about −2 KV was applied at the time of the transfer operation.

As the cleaning means, a urethane rubber cleaning blade was used. The cleaning blade was brought into contact with the cylindrical photosensitive member in a contrarotatory direction to the moving direction of the cylindrical photosensitive member at a contact pressure of about 20 g/cm.

| | |
|---|---|
| styrene-butyl-methacrylate copolymer (82:18) | 100 parts |
| magnetite | 80 parts |
| nigrosine dye (charge controlling agent) | 2 parts |
| low molecular weight polypropylene | 4 parts |

The foregoing material was sufficiently mixed by a Henschel mixer, and kneaded by an extruder set to 130° C. After the temperature had been lowered, the kneaded material was coarsely milled by a cutter mill, finely milled by a jet mill by making use of a jet stream and then classified by a pneumatic classifier. As a result, black fine powder (magnetic toner particles) was obtained.

While intensely stirring 100 parts of dry silica particles having a particle size of about 0.02 μm, a solution, obtained by diluting 15 parts of silicone oil to four times by xylene, was sprayed. The 15 parts of silicone oil have an amine equivalent of 700, a viscosity at 25° C. of 100 cpc and a side chain containing amine. While continuing stirring, the temperature of a stirring tank was raised to about 280° C., followed by maintaining the temperature for 2 hours. Then, the solution was cooled, so that dry silica adsorbing silicone oil was obtained.

Dry silica adsorbing silicone oil was added by 0.6 part to 100 parts of black fine powder (magnetic toner particles), followed by mixing with a Henschel mixer. As a result, a magnetic toner was obtained.

The toner thus obtained was applied to the foregoing image-forming apparatus, followed by evaluating the ease of transfer similarly to Example 1 under a low temperature and low humidity environment (15° C. and 10 % RH). The results are shown in Table 7.

TABLE 7

| | Wettability of silica | Average size of particles of toner (μm) | Proportion of toner having sizes below 4 μm (% by number) | Quantity of charged toner (μc/g) | Transfer rate |
|---|---|---|---|---|---|
| Example 17 | 88 | 7.0 | 14 | +21 | 92 |

EXAMPLES 18 TO 21

Toner was obtained similarly to Example 17 except for use of silica processed by amino denatured silicone oil having the wettability as shown in Table 8 to conduct experiments similar to Example 17.

TABLE 8

| | Wettability of silica | Average size of particles of toner (μm) | Proportion of toner having sizes below 4 μm (% by number) | Quantity of charged toner (μc/g) | Transfer ratio (%) |
|---|---|---|---|---|---|
| Example 18 | 72 | 7.0 | 14 | +19 | 89 |
| Example 19 | 88 | 7.0 | 14 | +21 | 92 |
| Example 20 | 92 | 7.0 | 14 | +23 | 90 |
| Example 21 | 96 | 7.0 | 14 | +23 | 86 |

EXAMPLE 22

An image forming apparatus arranged similarly to Example 8 was used.

The distance from the cylindrical photosensitive member and the developing sleeve was set to about 300 μm. Further, a DC bias of about −500 V and an AC bias, the Vpp of which was about 1400 V and the frequency of which was about 1800 Hz, were applied to the developing sleeve. An electrostatic latent image was developed by using the following magnetic toner.

A transfer roller (volume resistivity $10^8$ Ω.cm) for a laser beam printer LBP-A404 manufactured by Canon was employed. The transfer roller was brought into contact with the cylindrical photosensitive member at a contact pressure of about 10 g/cm. While rotating the cylindrical photosensitive member and the transfer roller at the same speed, a DC voltage of about +2 KV was applied at the time of the transfer operation.

As the cleaning means, a urethane rubber cleaning blade was used. The cleaning blade was brought into contact with the cylindrical photosensitive member in a contrarotatory direction to the moving direction of the cylindrical photosensitive member at a contact pressure of about 25 g/cm.

| | |
|---|---|
| styrene-butyl-methacrylate maleic acid monobutyl ester copolymer (80:18:2) | 100 parts |
| magnetite | 100 parts |
| Azo pigment containing metal | 0.5 parts |
| low molecular weight polypropylene | 4 parts |

The foregoing material was sufficiently mixed by a Henschel mixer, followed by kneading by an extruder set to 130° C. After the temperature had been lowered, the kneaded material was coarsely milled by a cutter mill, followed by fine milling by a jet mill by making use of a jet stream and then the material was classified by a pneumatic classifier. As a result, black fine powder (magnetic toner particles) was obtained.

Silica adsorbing silicone oil was obtained similarly to Example 17 except for use of dimethyl silicone oil having a viscosity of 100 cps at 25° C.

Then, 1.4 parts of the silica adsorbing silicone oil was added to 100 parts of black fine powder, followed by mixing with a Henschel mixer. As a result, magnetic toner was obtained. The toner was applied to the foregoing image forming apparatus, followed by evaluating the ease of transfer under a low temperature and low humidity environment (15° C. and 10 % RH). The results are shown in Table 9.

TABLE 9

| | Wettability of silica | Average size of particles of toner (μm) | Proportion of toner having sizes below 4 μm (% by number) | Quantity of charged toner (μc/g) | Transfer ratio (%) |
|---|---|---|---|---|---|
| Example 22 | 99 | 5.6 | 19 | −37 | 93 |

EXAMPLE 23

Toner similar to Example 17 was used to output 5,000 A4-longitudinal sheets by an image forming apparatus similar to Example 9 to evaluate the ease of cleaning and the adhesion of the toner to the photosensitive member.

The distance from the cylindrical photosensitive member and the developing sleeve was set to about 300 μm. Further, a DC bias of about −200 V and an AC bias, the Vpp of which was about 1200 V and the frequency of which was about 1800 Hz, were applied to the developing sleeve. An electrostatic latent image was developed by using the following magnetic toner.

A transfer roller (volume resistivity $10^8$ Ω.cm) for a laser beam printer LBP-A404 manufactured by Canon was employed. The transfer roller was brought into contact with the cylindrical photosensitive member at a contact pressure of about 5 g/cm. While rotating the cylindrical photosensitive member and the transfer roller at the same speed, a DC voltage of about −1.5 KV was applied at the time of the transfer operation.

As the cleaning means, a urethane rubber cleaning blade was used. The cleaning blade was brought into contact with the cylindrical photosensitive member in a contrarotatory direction to the moving direction of the cylindrical photosensitive member at a contact pressure of about 20 g/cm.

The results are shown in Table 10.

TABLE 10

| | Wettability of silica | Average size of particles of toner (μm) | Proportion of toner having sizes below 4 μm (% by number) | Quantity of charged toner (μc/g) | Defects in cleaning | Adhesion of toner |
|---|---|---|---|---|---|---|
| Example 23 | 88 | 7.0 | 14 | +21 | Not generated | Not generated |

EXAMPLES 24 TO 27

Toner was obtained similarly to Example 23 except for use of silica processed by amino denatured silicone oil having wettability as shown in Table 11. Experiments similarly to Example 23 were conducted. The results are shown in Table 11.

TABLE 11

| | Wettability of silica | Average size of particles of toner (μm) | Proportion of toner having sizes below 4 μm (% by number) | Quantity of charged toner (μc/g) | Defects in cleaning | Adhesion of toner |
|---|---|---|---|---|---|---|
| Example 24 | 72 | 7.0 | 14 | +19 | Not generated | Not generated |
| Example 25 | 82 | 7.0 | 14 | +21 | Not generated | Not generated |
| Example 26 | 92 | 7.0 | 14 | +23 | Not generated | Not generated |
| Example 27 | 98 | 7.0 | 14 | +23 | Not generated | Not generated |

EXAMPLE 28

Toner similar to that according to Example 22 was used, and an image forming apparatus similar to that according to Example 16 was used to measure the ease of transfer under a low temperature and low humidity environment (15° C./10 % RH).

TABLE 12

| | Wettability of silica | Average size of particles of toner (μm) | Proportion of toner having sizes below 4 μm (% by number) | Quantity of charged toner (μc/g) | Defects in cleaning | Adhesion of toner |
|---|---|---|---|---|---|---|
| Example 28 | 99 | 5.6 | 19 | −37 | Not generated | Not generated |

The distance from the cylindrical photosensitive member and the developing sleeve was set to about 300 μm. Further, a DC bias of about −500 V and an AC bias, the Vpp of which was about 1400 V and the frequency of which was about 1800 Hz, were applied to the developing sleeve. An electrostatic latent image was developed by using the following magnetic toner prepared by the same manner as in Example 22.

A transfer roller (volume resistivity $10^8$ Ω.cm) for a laser beam printer LBP-A404 manufactured by Canon was employed. The transfer roller was brought into contact with the cylindrical photosensitive member at a contact pressure of about 6 g/cm. While rotating the cylindrical photosensitive member and the transfer roller at the same speed, a DC voltage of about +1.5 KV was applied at the time of the transfer operation.

As the cleaning means, a urethane rubber cleaning blade was used. The cleaning blade was brought into contact with the cylindrical photosensitive member in a contrarotatory direction to the moving direction of the cylindrical photosensitive member at a contact pressure of about 25 g/cm.

The results are shown in Table 12.

EXAMPLES 29 AND 30

As the image forming apparatus, an apparatus similar to that according to Example 1 was used.

The distance from the cylindrical photosensitive member and the developing sleeve was set to about 300 μm. Further, a DC bias of about −200 V and an AC bias, the Vpp of which was about 1200 V and the frequency of which was about 1800 Hz, were applied to the developing sleeve. An electrostatic latent image was developed by using the following magnetic toner.

A transfer roller (volume resistivity $10^8$ Ω.cm) for a laser beam printer LBP-A404 manufactured by Canon was employed. The transfer roller was brought into contact with the cylindrical photosensitive member at a contact pressure of about 8 g/cm. While rotating the cylindrical photosensitive member and the transfer roller at the same speed, a DC voltage of about −2 KV was applied at the time of the transfer operation.

As the cleaning means, a urethane rubber cleaning blade was used. The cleaning blade was brought into contact with the cylindrical photosensitive member in a contrarotatory direction to the moving direction of the cylindrical photosensitive member at a contact pressure of about 20 g/cm.

| | |
|---|---|
| styrene-n-butyl-acrylate copolymer (80:20) | 100 parts |
| magnetite I (see Table 13) | 80 parts |
| nigrosine dye (positive charge controlling agent) | 2 parts |
| low molecular weight polypropylene | 4 parts |

The foregoing material was sufficiently mixed by a Henschel mixer, followed by kneading with an extruder set to 130° C. After the temperature had been lowered, the kneaded material was coarsely milled by a cutter mill, finely milled by a jet mill by making use of a jet stream and classified by a pneumatic classifier. As a result, black fine powder (magnetic toner particles) was obtained.

Then, 0.6 part of colloidal silica was added to 100 parts of the black fine powder, followed by mixing with the Henschel mixer. As a result, toner was obtained.

By performing an adjustment in the fine milling/classifying process, magnetic toner samples respectively having particle size distributions shown in Table 14 were produced.

The toner was adapted to the foregoing image forming apparatus, following by measuring the transfer ratio under a low temperature and low humidity environment (15° C./10 % RH). The results of the measurement are shown in Table 14.

COMPARATIVE EXAMPLE 3

Toner was obtained similarly to Example 29 except for use of magnetite III (see Table 13) in place of magnetite I and increase in the % by number of particles having sizes below 4.0 μm in the particle size distribution of black fine powder as shown in Table 14. The toner thus obtained was used to measure the transfer ratio similar to Example 29. The results are shown in Table 14.

EXAMPLE 31

Similar conditions to Example 29 were employed except for use of magnetite III (see Table 13) in place of magnetite I. The results are shown in Table 14.

TABLE 13

| | Shape | Particle size (μm) | BET specific area ($m^2/g$) |
|---|---|---|---|
| Magnetite I | sphere | 0.22 | 7.0 |
| Magnetite II | cubic | 0.42 | 8.0 |
| Magnetite III | sphere | 0.18 | 10.0 |

TABLE 14

| | Average size of particles of toner (μm) | Proportion of toner having sizes below 4 μm (% by number) | Quantity of charged toner (μc/g) | Transfer ratio (%) |
|---|---|---|---|---|
| Example 29 | 7.3 | 4 | +18 | 93 |
| Example 30 | 7.1 | 8 | +20 | 94 |
| Example 31 | 6.8 | 23 | +21 | 92 |
| Comparative Example 3 | 6.6 | 33 | +24 | 80 |

EXAMPLES 32 AND 33

Toner was manufactured by a method similar to that according to Example 29 except for the quantity of the charge controlling agent used in the toner as shown in Table 15 and for the change in the quantity of the charged toner. Experiments were conducted similar to Example 29, resulting in values as shown in Table 15.

TABLE 15

| | Charge control agent nigrosine dye (w %) | Average size of particles of toner (μm) | Proportion of toner having sizes below 4 μm (% by number) | Quantity of charged toner (μc/g) | Transfer ratio (%) |
|---|---|---|---|---|---|
| Example 32 | 0.5 | 7.4 | 10 | +13 | 93 |
| Example 33 | 1 | 7.0 | 12 | +18 | 93 |

EXAMPLE 34

As the image forming apparatus, an apparatus similar to that according to Example 8 was used.

The distance from the cylindrical photosensitive member and the developing sleeve was set to about 300 μm. Further, a DC bias of about −500 V and an AC bias, the Vpp of which was about 1400 V and the frequency of which was about 1800 Hz, were applied to the developing sleeve. An electrostatic latent image was developed by using the following magnetic toner.

A transfer roller (volume resistivity $10^8$ Ω.cm) for a laser beam printer LBP-A404 manufactured by Canon was employed. The transfer roller was brought into contact with the cylindrical photosensitive member at a contact pressure of about 12 g/cm. While rotating the cylindrical photosensitive member and the transfer roller at the same speed, a DC voltage of about +2 KV was applied at the time of the transfer operation.

As the cleaning means, a urethane rubber cleaning blade was used. The cleaning blade was brought into contact with the cylindrical photosensitive member in a contrarotatory direction to the moving direction of the cylindrical photosensitive member at a contact pressure of about 25 g/cm.

| | |
|---|---|
| styrene-n-butyl-acrylate maleic acid monobutyl ester copolymer (77:20:3) | 100 parts |
| magnetite I (see Table 13) | 100 parts |
| Azo pigment containing metal | 0.5 parts |
| low molecular weight polypropylene | 4 parts |

The foregoing material was sufficiently mixed by a Henschel mixer, followed by kneading with an extruder set to 130° C. After the temperature had been lowered, the kneaded material was coarsely milled by a cutter mill, finely milled by a jet mill by making use of a jet stream and then classified by a pneumatic classifier. As a result, black fine powder (magnetic toner particles) was obtained.

Then, 1.6 parts of colloidal silica was added to 100 parts of the black fine powder, followed by mixing with the Henschel mixer. As a result, magnetic toner was obtained.

The toner was adapted to the foregoing image forming apparatus, following by measuring the transfer ratio under a low temperature and low humidity environment (15° C./10 % RH). The results of the measurement are shown in Table 16.

TABLE 16

| | Average size of particles of toner (μm) | Proportion of toner having sizes below 4 μm (% by number) | Quantity of charged toner (μc/g) | Transfer ratio (%) |
|---|---|---|---|---|
| Example 34 | 5.5 | 18 | −35 | 93 |

EXAMPLES 35 AND 36

Toner similar to Examples 29 and 30 was used to output 5,000 A4-longitudinal sheets by an image forming apparatus similar to Example 9 under a low temperature and low humidity environment (15° C./10 % RH) to evaluate the cleaning ease and the adhesion of the toner to the photosensitive member.

The distance from the cylindrical photosensitive member and the developing sleeve was set to about 300 μm. Further, a DC bias of about −200 V and an AC bias, the Vpp of which was about 1200 V and the frequency of which was about 1800 Hz, were applied to the developing sleeve. An electrostatic latent image was developed by using the following magnetic toner prepared by the same manner as in Example 29.

A transfer roller (volume resistivity $10^8$ Ω.cm) for a laser beam printer LBP-A404 manufactured by Canon was employed. The transfer roller was brought into contact with the cylindrical photosensitive member at a contact pressure of about 6 g/cm. While rotating the cylindrical photosensitive member and the transfer roller at the same speed, a DC voltage of about −1.5 KV was applied at the time of the transfer operation.

As the cleaning means, a urethane rubber cleaning blade was used. The cleaning blade was brought into contact with the cylindrical photosensitive member in a contrarotatory direction to the moving direction of the cylindrical photosensitive member at a contact pressure of about 20 g/cm.

The results are shown in Table 17.

COMPARATIVE EXAMPLE 4

Toner similar to Comparative Example 3 was used, and experiments similar to Example 35 were performed. The results are shown in Table 17.

EXAMPLE 37

Toner similar to Example 31 was used, and experiments similar to Example 35 were performed. The results are shown in Table 17.

TABLE 17

| | Average size of particles of toner (μm) | Proportion of toner having sizes below 4 μm (% by number) | Quantity of charged toner (μc/g) | Defective result in cleaning | Adhesion of toner |
|---|---|---|---|---|---|
| Example 35 | 7.3 | 4 | +18 | Not generated | Not generated |
| Example 36 | 7.1 | 8 | +20 | Not generated | Not generated |
| Example 37 | 6.8 | 23 | +21 | Not generated | Not generated |
| Comparative Example 4 | 6.6 | 33 | +24 | generated when 300 sheets had been outputted | generated when 1500 sheets had been outputted |

EXAMPLES 38 AND 39

Toner was manufactured by a method similar to that according to Example 29 except for the quantity of the charge controlling agent for use in the toner arranged as shown in Table 18 and for the change in the quantity of the charged toner. Experiments were conducted similarly to Example 35, resulting values as shown in Table 18.

TABLE 18

| | Charge control agent Nigrosine dye (w %) | Average size of particles of toner (μm) | Proportion of toner having sizes below 4 μm (% by weight) | Quantity of charged toner (μc/g) | Defects in cleaning | Adhesion of toner | Flying* of toner |
|---|---|---|---|---|---|---|---|
| Example 38 | 0.5 | 7.4 | 10 | +13 | Not generated | Not generated | Not observed |
| Example 39 | 1 | 7.0 | 12 | +18 | Not generated | Not generated | Not observed |

*"flying of toner" was evaluated by observing the developing device and the lower stay of the developing sleeve.

EXAMPLE 40

Toner similar to Example 34 was adapted to an image forming apparatus arranged similar to Example 16 to evaluate the cleaning ease and the adhesion of the toner to the photosensitive member under a low temperature and low humidity environment (15° C./10 % RH) similar to Example 35.

The distance from the cylindrical photosensitive member and the developing sleeve was set to about 300 μm. Further, a DC bias of about −200 V and an AC bias, the Vpp of which was about 1200 V and the frequency of which was about 1800 Hz, were applied to the developing sleeve. An electrostatic latent image was developed by using the following magnetic toner prepared by the same manner as in Example 34.

A transfer roller (volume resistivity $10^8$ Ω.cm) for a laser beam printer LBP-A404 manufactured by Canon was employed. The transfer roller was brought into contact with the cylindrical photosensitive member at a contact pressure of about 8 g/cm. While rotating the cylindrical photosensitive member and the transfer roller at the same speed, a DC voltage of about +1.5 KV was applied at the time of the transfer operation.

As the cleaning means, a urethane rubber cleaning blade was used. The cleaning blade was brought into contact with the cylindrical photosensitive member in a contrarotatory direction to the moving direction of the cylindrical photosensitive member at a contact pressure of about 25 g/cm.

The results are shown in Table 19.

A transfer roller (volume resistivity $0^8$ Ω.cm) for a laser beam printer LBP-A404 manufactured by Canon was employed. The transfer roller was brought into contact with the cylindrical photosensitive member at a contact pressure of about 4 g/cm. While rotating the cylindrical photosensitive member and the transfer roller at the same speed, a DC voltage of about −2 KV was applied at the time of the transfer operation.

As the cleaning means, a urethane rubber cleaning blade was used. The cleaning blade was brought into contact with the cylindrical photosensitive member in a contrarotatory direction to the moving direction of the cylindrical photosensitive member at a contact pressure of about 15 g/cm.

| | |
|---|---|
| styrene-n-butyl-acrylate copolymer (copolymerization ratio 80:20) | 100 parts |
| magnetite IV (see Table 20) | 80 parts |
| nigrosine dye | 2 parts |
| low molecular weight polypropylene | 4 parts |

The foregoing material was sufficiently mixed by a Henschel mixer, followed by kneading by an extruder set to 130° C. After the temperature had been lowered, the kneaded material was coarsely milled by a cutter mill, finely milling by a jet mill by making use of a jet stream and then classified by a pneumatic classifier. As a result, black fine powder (toner) was obtained.

Then, 0.6 part of colloidal silica was added to 100 parts of the black fine powder, followed by mixing with the Henschel mixer. As a result, toner was obtained.

TABLE 19

| | Average size of particles of toner (μm) | Proportion of toner having sizes below 4 μm (% by number) | Quantity of charged toner (μc/g) | Defective result in cleaning | Adhesion of toner |
|---|---|---|---|---|---|
| Example 40 | 5.5 | 18 | −35 | Not generated | Not generated |

EXAMPLE 41

As the image forming apparatus, an apparatus similar to that according to Example 1 was used.

The distance from the cylindrical photosensitive member and the developing sleeve was set to about 300 μm. Further, a DC bias of about −200 V and an AC bias, the Vpp of which was about 1200 V and the frequency of which was about 1800 Hz, were applied to the developing sleeve. An electrostatic latent image was developed by using the following magnetic toner.

By performing an adjustment in the fine milling/classifying process, magnetic toner samples respectively having particle size distributions shown in Table 21 were produced.

The toner was adapted to the foregoing image forming apparatus, following by measuring the transfer ratio under a low temperature and low humidity environment (15° C./10 % RH). The results of the measurement are shown in Table 21.

COMPARATIVE EXAMPLE 5

Toner was obtained similarly to Example 41 except for use of magnetite VII (see Table 20) in place of magnetite IV and an increase in % by number of particles having sizes below 4.0 μm in the particle size distribution of black fine powder as shown in Table 21. The toner thus obtained was used to measure the transfer ratio similar to Example 41. The results are shown in Table 21.

EXAMPLES 42 AND 43

Toner was obtained similarly to Example 41 except for use of magnetite V and magnetite VI (see Table 20) in place of magnetite IV. The results are shown in Table 21

TABLE 20

| | Particle size (μm) | Quantity of Si atoms (wt %) | Quantity of Al atoms (wt %) |
|---|---|---|---|
| Magnetite IV | 0.25 | 0.5 | 0.5 |
| Magnetite V | 0.15 | 0.02 | 0.7 |
| Magnetite VI | 0.20 | 1.0 | 0.02 |
| Magnetite VII | 0.37 | 0.03 | 0.03 |

TABLE 21

| | Average size of particles of toner (μm) | Proportion of toner having sizes below 4 μm (% by number) | Quantity of charged toner (μc/g) | Transfer ratio (%) |
|---|---|---|---|---|
| Example 41 | 7.3 | 5 | +17 | 94 |
| Example 42 | 7.2 | 10 | +16 | 95 |
| Example 43 | 6.9 | 20 | +19 | 91 |
| Comparative Example 5 | 6.7 | 32 | +21 | 78 |

EXAMPLES 44 AND 45

Toner was manufactured by a method similar to that according to Example 41 except for the quantity of the charge controlling agent for use in the toner was as shown in Table 22 and for the change in the quantity of the charged toner. Experiments were conducted similar to Example 41, resulting in values as shown in Table 22.

TABLE 22

| | Charge control agent Nigrosine dye (w %) | Average size of particles of toner (μm) | Proportion of toner having sizes below 4 μm (% by number) | Quantity of charged toner (μc/g) | Transfer ratio (%) |
|---|---|---|---|---|---|
| Example 44 | 0.5 | 7.0 | 11 | +10 | 92 |
| Example 45 | 1 | 7.2 | 9 | +15 | 92 |

EXAMPLE 46

As the image forming apparatus, an apparatus similar to that according to Example 8 was used.

The distance from the cylindrical photosensitive member and the developing sleeve was set to about 300 μm. Further, a DC bias of about −200 V and an AC bias, the Vpp of which was about 1200 V and the frequency of which was about 1800 Hz, were applied to the developing sleeve. An electrostatic latent image was developed by using the following magnetic toner.

A transfer roller (volume resistivity $10^8$ Ω.cm) for a laser beam printer LBP-A404 manufactured by Canon was employed. The transfer roller was brought into contact with the cylindrical photosensitive member at a contact pressure of about 6 g/cm. While rotating the cylindrical photosensitive member and the transfer roller at the same speed, a DC voltage of about +2 KV was applied at the time of the transfer operation.

As the cleaning means, a urethane rubber cleaning blade was used. The cleaning blade was brought into contact with the cylindrical photosensitive member in a contrarotatory direction to the moving direction of the cylindrical photosensitive member at a contact pressure of about 20 g/cm.

| | |
|---|---|
| styrene-n-butyl-acrylate maleic acid monobutyl ester copolymer (77:20:3) | 100 parts |
| magnetite IV (see Table 20) | 100 parts |
| Azo pigment containing metal | 0.5 parts |
| low molecular weight polypropylene | 4 parts |

The foregoing material was sufficiently mixed by a Henschel mixer, followed by kneading by an extruder set to 130° C. After the temperature had been lowered, the kneaded material was coarsely milled by a cutter mill, finely milled by a jet mill by making use of a jet stream and then classified by a pneumatic classifier. As a result, black fine powder (magnetic toner particles) was obtained.

Then, 1.6 parts of colloidal silica was added to 100 parts of the black fine powder, followed by mixing with the Henschel mixer. As a result, toner was obtained.

The toner was adapted to the foregoing image forming apparatus, following by measuring the transfer ratio under a low temperature and low humidity environment (15° C./10 % RH). The results of the measurement are shown in Table 23.

TABLE 23

| | Average size of particles of toner (μm) | Proportion of toner having sizes below 4 μm (% by number) | Quantity of charged toner (μc/g) | Transfer ratio (%) |
|---|---|---|---|---|
| Example 46 | 5.7 | 22 | −30 | 94 |

EXAMPLE 47

Toner similar to Example 41 was used to output 5,000 A4-longitudinal sheets by an image forming apparatus similar to Example 9 under a low temperature and low humidity environment (15° C./10 % RH) to evaluate the ease of cleaning and the adhesion of the toner to the photosensitive member.

The distance from the cylindrical photosensitive member and the developing sleeve was set to about 300 μm. Further, a DC bias of about −200 V and an AC bias, the Vpp of which was about 1200 V and the frequency of which was about 1800 Hz, were applied to the developing sleeve. An electrostatic latent image was developed in a reversal development method by using the following magnetic toner prepared by the same manner as in Example 41.

A transfer roller (volume resistivity $10^8$ Ω.cm) for a laser beam printer LBP-A404 manufactured by Canon was employed. The transfer roller was brought into contact with the cylindrical photosensitive member at a contact pressure of about 4 g/cm. While rotating the cylindrical photosensitive member and the transfer roller at the same speed, a DC voltage of about −1.5 KV was applied at the time of the transfer operation.

As the cleaning means, a urethane rubber cleaning blade was used. The cleaning blade was brought into contact with the cylindrical photosensitive member in a contrarotatory direction to the moving direction of the cylindrical photosensitive member at a contact pressure of about 15 g/cm.

The results are shown in Table 24.

COMPARATIVE EXAMPLE 6

Toner similar to that according to Comparative Example 5 was used to conduct experiments similar to that according to Example 47. The results are shown in Table 24.

EXAMPLES 48 AND 49

Toner similar to that according to Examples 42 and 43 was used to conduct experiment similar to that according to Example 47. The results are shown in Table 24.

TABLE 24

| | Average size of particles of toner (μm) | Proportion of toner having sizes below 4 μm (% by number) | Quantity of charged toner (μc/g) | Defective result in cleaning | Adhesion of toner |
|---|---|---|---|---|---|
| Example 47 | 7.3 | 5 | +17 | Not generated | Not generated |
| Example 48 | 7.2 | 10 | +16 | Not generated | Not generated |
| Example 49 | 6.9 | 20 | +19 | Not generated | Not generated |
| Comparative Example 6 | 6.7 | 32 | +21 | generated when 300 sheets had been outputted | generated when 1500 sheens had been outputted |

EXAMPLES 50 AND 51

Toner was produced similar to Example 41 except for change in the quantity of the charge control agent for use in the toner as shown in Table 25 and for the quantity of the charged quantity to conduct experiments similar to Example 47. The results are shown in Table 25.

TABLE 25

| | Charge control agent Nigrosine dye (w %) | Average size of particles of toner (μm) | Proportion of toner having sizes below 4 μm (% by weight) | Quantity of charged toner (μc/g) | Defects in cleaning | Adhesion of toner | Flying* of toner |
|---|---|---|---|---|---|---|---|
| Example 50 | 0.5 | 7.0 | 11 | +10 | Not generated | Not generated | Not observed |
| Example 51 | 1 | 7.2 | 9 | +15 | Not generated | Not generated | Not observed |

*"flying of toner" was evaluated by observing the developing device and the lower stay of the developing sleeve.

EXAMPLE 52

Toner similar to Example 46 was applied to an image forming apparatus arranged similar to Example 16 to evaluate the ease of cleaning and the adhesion of toner to the photosensitive member similar to Example 47 under a low temperature and low humidity environment (15° C./10 % RH).

The distance from the cylindrical photosensitive member and the developing sleeve was set to about 300 μm. Further, a DC bias of about −200 V and an AC bias, the Vpp of which was about 1200 V and the frequency of which was about 1800 Hz, were applied to the developing sleeve. An electrostatic latent image was developed in a reversal development method by using the following magnetic toner prepared by the same manner as in Example 46.

A transfer roller (volume resistivity $10^8$ Ω.cm) for a laser beam printer LBP-A404 manufactured by Canon was employed. The transfer roller was brought into contact with the cylindrical photosensitive member at a contact pressure of about 4 g/cm. While rotating the cylindrical photosensitive member and the transfer roller at the same speed, a DC voltage of about +1.5 KV was applied at the time of the transfer operation.

As the cleaning means, a urethane rubber cleaning blade was used. The cleaning blade was brought into contact with the cylindrical photosensitive member in a contrarotatory direction to the moving direction of the cylindrical photosensitive member at a contact pressure of about 20 g/cm.

The results are shown in Table 26.

TABLE 26

| | Average size of particles of toner (μm) | Proportion of toner having sizes below 4 μm (% by number) | Quantity of charged toner (μc/g) | Defective result in cleaning | Adhesion of toner |
|---|---|---|---|---|---|
| Example 52 | 5.7 | 22 | −35 | Not generated | Not generated |

As described above, according to the present invention, a high transfer ratio can be realized, and a high grade image exhibiting a high image density can be formed. Further, cleaning can easily be performed, and the adhesion of toner to the photosensitive member does not readily take place. Therefore, transfer of an image can be performed satisfactorily.

Although the invention has been described in its preferred form with a certain degree of particularly, it is understood that the present disclosure of the preferred form may be changed in the details of construction. New and different combinations and arrangement of parts may be resorted to without departing from the spirit and the scope of the invention as hereinafter claimed.

What is claimed is:

1. An image forming method comprising:

(a) charging a cylindrical photosensitive member with a diameter of 35 mm or less and rotating at a peripheral speed v (mm/sec.);

(b) exposing said photosensitive member so that an electrostatically charged image is formed;

(c) developing said electrostatically charged image at a developing position with a toner having a triboelectric charge of |5| to |50| μc/g and containing 30% by number or less of toner particle having sizes below 4 μm so that a toner image is formed;

(d) transferring said toner image at a transfer position to a transfer member by a contact transfer means, said transfer means disposed so that the distance from the developing position on said photosensitive member to the transfer position in a direction of rotation of said photosensitive member is $d_1$ (mm), wherein the ratio $d_1/v$ is 0.17 sec. or less; and (e) cleaning residual toner particles on said photosensitive member by cleaning means after said toner image has been transferred.

2. The method according to claim 1, wherein said cleaning means is disposed so that the distance from the developing position on said photosensitive member to the cleaning position in a direction of rotation of said photosensitive member is $d_2$ (mm), and $d_2/v$ is 0.32 sec or less.

3. The method according to claim 1 or 2, wherein said toner contains 25% by number or less of toner particles having sizes below 4 μm in distribution of the number of toner particles.

4. The method according to claim 1 or 2, wherein said toner contains 20% by number or less of toner particles having sizes below 4 μm in distribution of the number of toner particles.

5. The method according to claim 1 or 2, wherein said toner has a triboelectric charge of |5.5| to |45| μc/g.

6. The method according to claim 1 or 2, wherein said toner has a triboelectric charge of |6| to |42| μc/g.

7. The method according to claim 1 or 2, including employing as said toner, magnetic toner particles containing (i) magnetic particles of a spherical magnetic substance, the surface of which is formed by a curved surface, and (ii) binding resin.

8. The method according to claim 1 or 2, including employing as said toner magnetic toner particles containing (i) magnetic particles, said magnetic particles containing silicon, aluminum or mixtures thereof in amounts from 0.05 to 10 wt. % and (ii) binding resin.

9. The method according to claim 1 or 2, including employing as said toner magnetic toner particles containing (i) magnetic particles, said magnetic particles containing silicon, aluminum or mixtures thereof in amounts from 0.1 to 5 wt. %, and (ii) binding resin.

10. The method according to claim 1 or 2, including transferring said toner image to said transfer member by said transfer means, wherein voltage is applied to said transfer means.

11. The method according to claim 1 or 2, including transferring said toner image to said transfer member by said transfer means, wherein said transfer means has a transfer belt and voltage is applied to said transfer means.

12. The method according to claim 1 or 2, including removing the residual toner particles on said photosensitive member by blade cleaning.

13. The method according to claim 1 or 2, including removing the residual toner particles on said photosensitive member by roller cleaning.

14. The method according to claim 1 or 2, including setting said developing position to a position from +10° to −30° from the horizontal line of the center of said cylindrical photosensitive member; setting said transfer position to a position in a range of ±20° from the vertical line of the center of said cylindrical photosensitive member; setting a cleaning position to a position from +10° to −30° from the horizontal line of the center of said cylindrical photosensitive member, and providing an angle between said developing position and the center of said cylindrical photosensitive member and between said cleaning position and said center of said cylindrical photosensitive member which is the same and is an angle between 120° to 200°.

15. The method according to claim 2, where $d_1/v$ is 0.15 sec. or less and $d_2/v$ is 0.3 sec. or less.

16. The method according to claim 2, where $d_1/v$ is 0.10 to 0.13 sec. and $d_2/v$ is 0.20 to 0.25 sec.

17. The method according to claim 1, wherein the cylindrical photosensitive member has a diameter of 30 mm or less.

18. The method according to claim 17, wherein the cylindrical photosensitive member has a diameter of 20 to 30 mm.

19. The method according to claim 1, wherein the toner is a magnetic toner containing magnetic particles.

20. The method according to claim 19, wherein the magnetic particles contained in the magnetic toner contain silicon, aluminum, or a mixture thereof.

21. The method according to claim 1, wherein the contact transfer means is a transfer roller.

* * * * *

UNITED STATES PATENT AND TRADEMARK OFFICE

CERTIFICATE OF CORRECTION

PATENT NO. : 5,532,101

DATED : July 2, 1996

INVENTOR(S) : KEITA NOZAWA ET AL.

It is certified that error appears in the above-identified patent and that said Letters Patent is hereby corrected as shown below:

COLUMN 2

Line 8, "appear" should read --apparent--.
Line 63, "photosensitive" should read --photosensitive member--.

COLUMN 3

Line 17, "containing" should read --contained--.

COLUMN 4

Line 2, "about from" should read --around--.

COLUMN 6

Line 3, "(preferable" should read --(preferably--.
Line 61, "an/or" should read --and/or--.
Line 66, "0.05 wt %" should read --0.05 wt %,--.

COLUMN 7

Line 24, "to to" should read --to--.
Line 42, "removed" should read --remove--.
Line 51, "magnetite," should be deleted.

COLUMN 8

Line 16, "affect" should read --effect--.
Line 25, "FIG. 1" should read --FIGS. 1--.

UNITED STATES PATENT AND TRADEMARK OFFICE

CERTIFICATE OF CORRECTION

PATENT NO. : 5,532,101

DATED : July 2, 1996

INVENTOR(S) : KEITA NOZAWA ET AL.

It is certified that error appears in the above-identified patent and that said Letters Patent is hereby corrected as shown below:

COLUMN 9

Line 64, "θ1" should read --$\theta_1$--.

COLUMN 10

Line 4, "angle θ2" should read --angle $\theta_2$

COLUMN 13

Line 35, "following" should read --followed--.

COLUMN 14

Line 8, "angle θ2" should read --angle $\theta_2$

COLUMN 16

Line 45, "following" should read --followed--.

COLUMN 26

Line 64, "resulting" should read --resulting in--.

COLUMN 28

Line 14, "$0^8$ Ω.cm)" should read --$10^8$ Ω.cm)--.
Line 37, "milling" should read --milled--.
Line 59, "following" should read --followed--.

UNITED STATES PATENT AND TRADEMARK OFFICE

CERTIFICATE OF CORRECTION

PATENT NO. : 5,532,101

DATED : July 2, 1996

INVENTOR(S) : KEITA NOZAWA ET AL.

It is certified that error appears in the above-identified patent and that said Letters Patent is hereby corrected as shown below:

COLUMN 30

Line 32, "following" should read --followed--.

COLUMN 33

Line 18, "particularly," should read --particularity,--.
Line 35, "particle" should read --particles--.
Line 51, "0.32 sec" should read --0.32 sec.--.

Signed and Sealed this

Twenty-ninth Day of October 1996

*Attest:*

*Attesting Officer*

BRUCE LEHMAN

*Commissioner of Patents and Trademarks*